US007774919B2

(12) United States Patent
Bublitz et al.

(10) Patent No.: US 7,774,919 B2
(45) Date of Patent: Aug. 17, 2010

(54) METHOD OF USE OF COLLAPSIBLE CONTAINER FOR AIR SHIPMENT OF CARGO

(75) Inventors: Timothy A. Bublitz, Grand Haven, MI (US); Brian T. Dobrinski, Zeeland, MI (US)

(73) Assignee: Bradford Company, Holland, MI (US)

( * ) Notice: Subject to any disclaimer, the term of this patent is extended or adjusted under 35 U.S.C. 154(b) by 0 days.

(21) Appl. No.: 12/469,041

(22) Filed: May 20, 2009

(65) Prior Publication Data

US 2009/0223038 A1 Sep. 10, 2009

Related U.S. Application Data

(62) Division of application No. 11/385,509, filed on Mar. 21, 2006, now Pat. No. 7,540,390.

(51) Int. Cl.
*B23P 11/00* (2006.01)
*B65D 88/00* (2006.01)

(52) U.S. Cl. ..... 29/525.01; 220/1.5

(58) Field of Classification Search ..... 29/525.01, 29/897, 897.3, 428, 801; 220/1.5, 4.29, 4.33, 220/4.28, 9.2, 9.3, 4.34, 6, 666, 7; 52/79.1, 52/79.5

See application file for complete search history.

(56) References Cited

U.S. PATENT DOCUMENTS

| | | | |
|---|---|---|---|
| 3,552,466 | A | 1/1971 | Fairchilds |
| 4,684,034 | A | 8/1987 | Ono et al. |
| 4,860,912 | A | 8/1989 | Kupersmit |
| 5,279,437 | A | 1/1994 | Kupersmit |
| 5,493,818 | A | 2/1996 | Wilson |
| 5,890,612 | A | 4/1999 | Coppi |
| 5,941,405 | A | 8/1999 | Scales et al. |
| 6,216,638 | B1 | 4/2001 | Pivonka et al. |
| 6,386,383 | B1 | 5/2002 | Roudonis |
| 7,540,390 | B2 | 6/2009 | Bublitz et al. |

*Primary Examiner*—John C Hong
(74) *Attorney, Agent, or Firm*—Wood, Herron & Evans, LLP

(57) ABSTRACT

A collapsible cargo container (10) is configurable into an erected condition and a collapsed condition. The container (10) comprises a base (12), a pair of opposed side walls (14) hinged to the base (12), a top (16) hinged to the side walls (14), a front wall (18) hinged to the base (12), a back wall (20) hinged to the base (12), flaps (22, 24, 26, 28, 30 and 32) hinged to the side walls (14) and top (16), and a door (34) formed in one of the walls. Fasteners (36) secure the flaps (22, 24, 26, 28, 30 and 32) to the front and back walls (18, 20) when the container (10) is in the erected condition. The front and back walls (18, 20) are collapsible upon the base (12) and the side walls (14) and top (16) are collapsible upon the front and back walls (18, 20) when the container (10) is in the collapsed condition.

5 Claims, 7 Drawing Sheets

METHOD OF USE OF COLLAPSIBLE CONTAINER FOR AIR SHIPMENT OF CARGO

CROSS-REFERENCE TO RELATED APPLICATIONS

This application is a divisional of U.S. patent application Ser. No. 11/385,509 filed Mar. 21, 2006 entitled COLLAPSIBLE CONTAINER FOR AIR SHIPMENT OF CARGO AND METHOD OF USE, which is fully incorporated by reference herein.

FIELD

The present invention relates to a collapsible container for use in an aircraft cargo hold.

BACKGROUND

Special containers are used on aircraft for storing fragile parcels containing breakable or perishable goods, or for storing passenger luggage. Due to the limited space available in aircraft cargo holds, the shape of such a container is generally designed to fit the shape of the walls of the aircraft cargo hold or luggage compartment. One of the most important factors airlines use in selecting a suitable container for use in an aircraft cargo hold is gross weight. The heavier the container, the heavier the airplane and the more fuel that must be used to fly a predetermined distance.

In order to reduce the space occupied by such a container once it has been emptied, such a container has been designed to collapse. For example, U.S. Pat. No. 5,890,612 discloses a collapsible aircraft container which has a rigid base frame supporting an accordion folding frame. The collapsible container has sides made of canvas and sheet metal plates. The frames are made of steel. Therefore, the container is heavy, even when empty.

Another collapsible aircraft container is disclosed in U.S. Pat. No. 5,941,405. This collapsible aircraft container has a base, support posts and roof made of aluminum and flexible side walls formed from light weight fabric. Again, due to the support posts, the container is heavy, even when empty.

In each of these collapsible aircraft containers, the less the weight the better, as long as the container is sturdy enough to handle normal wear and tear of such use. Consequently, there is a need for a lightweight, collapsible airline container which does not include a frame or support posts, thereby reducing its weight.

SUMMARY

The present invention is a collapsible cargo container which is configurable into an erected condition and a collapsed condition. The container comprises a base, a pair of opposed side walls hinged to the base, a top hinged to the side walls, a front wall hinged to the base, a back wall hinged to the base, flaps hinged to the side walls and top, and a door formed in one of the walls. Fasteners secure the flaps to the front and back walls when the container is in the erected condition. The front and back walls are collapsible upon the base and the side walls and top are collapsible upon the front and back walls when the container is in the collapsed condition.

The base, top, side walls, front wall, and back wall can be plastic. The fasteners can be rotatable latches. Each of the rotatable latches can be attached to the flaps, and the front and back walls can be provided with openings for receiving the rotatable latches. Each of the side walls can have an upper side wall panel hinged to a lower side wall panel. Each of the upper side wall panels can be hinged to form an upper portion and a lower portion, such that when the container is collapsed, the upper portion of the upper side wall panel overlies the lower portion of the upper side wall panel. The upper side wall panels can be angled inwardly relative to the lower side wall panels. The back wall can have an upper portion hinged to a lower portion, such that when the container is collapsed, the upper portion of the back wall overlies the lower portion of the back wall. The upper portion of the back wall can angle forwardly relative to the lower portion of the back wall. The door can be lockable in a closed position. The base, side walls, and top can be hinged together via living hinges. The base, side walls, and top can be integrally formed as a single, one-piece, seamless structure. The front and back walls can be hinged to the base via extruded hinges. The flaps that are secured to the front wall with fasteners can be hinged to the side walls and top via living hinges. The flaps that are secured to the back wall with fasteners and that are hinged to the upper side wall panels and hinged to the top are hinged thereto with extruded hinges, and the flaps that are secured to the back wall with fasteners and that are hinged to the lower side wall panels are hinged thereto with living hinges. The door can be formed in the front wall.

In another aspect, the present invention is a method of erecting a collapsed cargo container. The method comprises the steps of providing a collapsed cargo container having a base, a pair of opposed side walls hinged to the base, a top hinged to the side walls, a front wall hinged to the base, a back wall hinged to the base, flaps hinged to the side walls and top, and a door formed in one of the walls, lifting the top and side walls of the container to thereby erect the side walls of the container, lifting the front wall of the container to pivot the front wall of the container forwardly relative to the base of the container, fastening flaps on the side walls and top to the front wall with fasteners, lifting the back wall of the container to pivot the back wall of the container rearwardly relative to the base of the container, and fastening flaps on the side walls and top to the back wall with fasteners.

The fasteners can be rotatable latches attached to the flaps, and the method can further comprise the steps of providing openings in the front and back walls, passing the rotatable latches through the openings, and rotating the latches.

In yet another aspect, a collapsible cargo container is provided which is configurable into an erected condition and a collapsed condition which comprises a base, a pair of opposed side walls hinged to the base, a top hinged to the side walls, a front wall hinged to the base, a back wall hinged to the base, flaps hinged to the side walls and top, and a door formed in one of the walls. Fasteners secure the flaps to the front and back walls when the container is in the erected condition. The side walls, top, front wall, and back wall are collapsible so as to be substantially parallel to, and generally in close proximity to, the base when the container is in the collapsed condition.

In still another aspect, a method of erecting a collapsed cargo container comprises the steps of providing a collapsed cargo container having a base, a pair of opposed side walls hinged to the base, a top hinged to the side walls, a front wall hinged to the base, a back wall hinged to the base, flaps hinged to the side walls and top, and a door formed in one of the walls, the side walls, top, front wall, and back wall being collapsed so as to be substantially parallel to, and generally in close proximity to, the base, and, in no particular order, lifting the top and side walls of the container to thereby erect the side walls of the container, lifting the front wall of the container to pivot the front wall of the container forwardly relative to the base of the container, fastening flaps on the side walls and top to the front wall with fasteners, lifting the back wall of the container to pivot the back wall of the container rearwardly relative to the base of the container, and fastening flaps on the side walls and top to the back wall with fasteners.

DRAWINGS

DESCRIPTION

Figure 1:
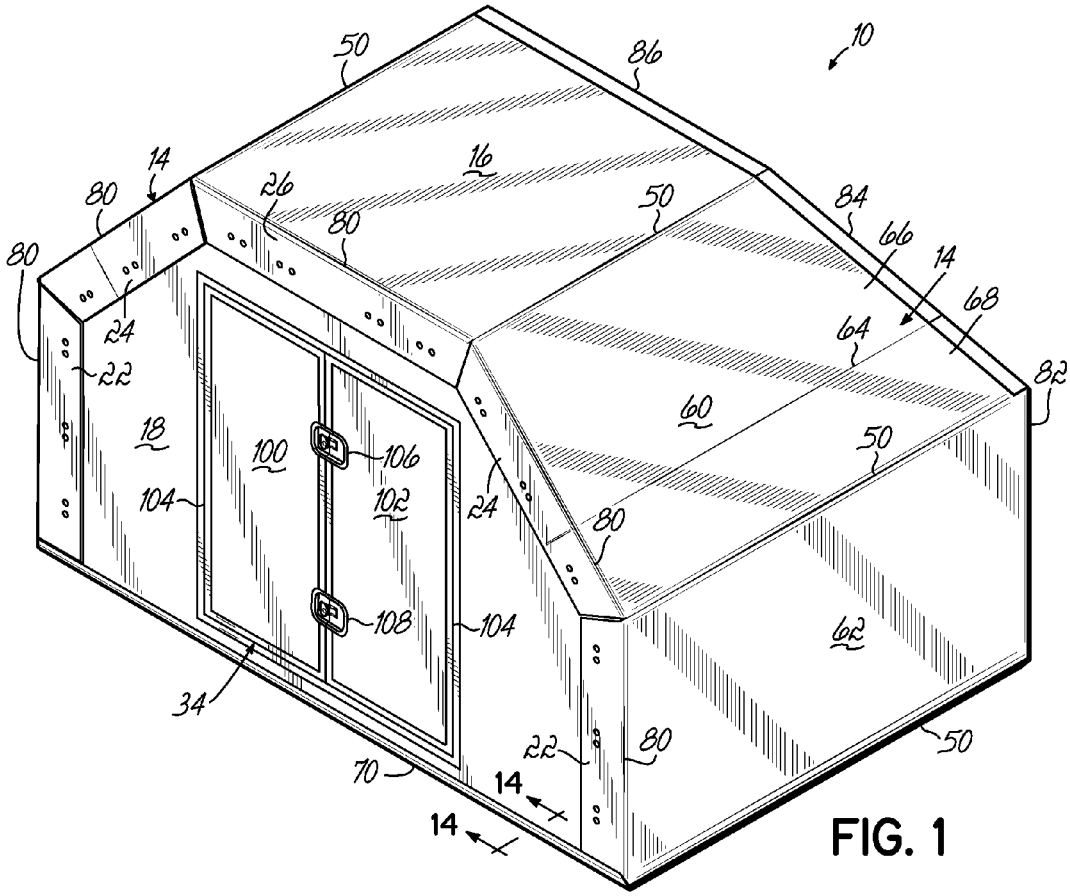
FIG. 1 is a front perspective view of the container of the present invention in an erected condition.
Figure 2:
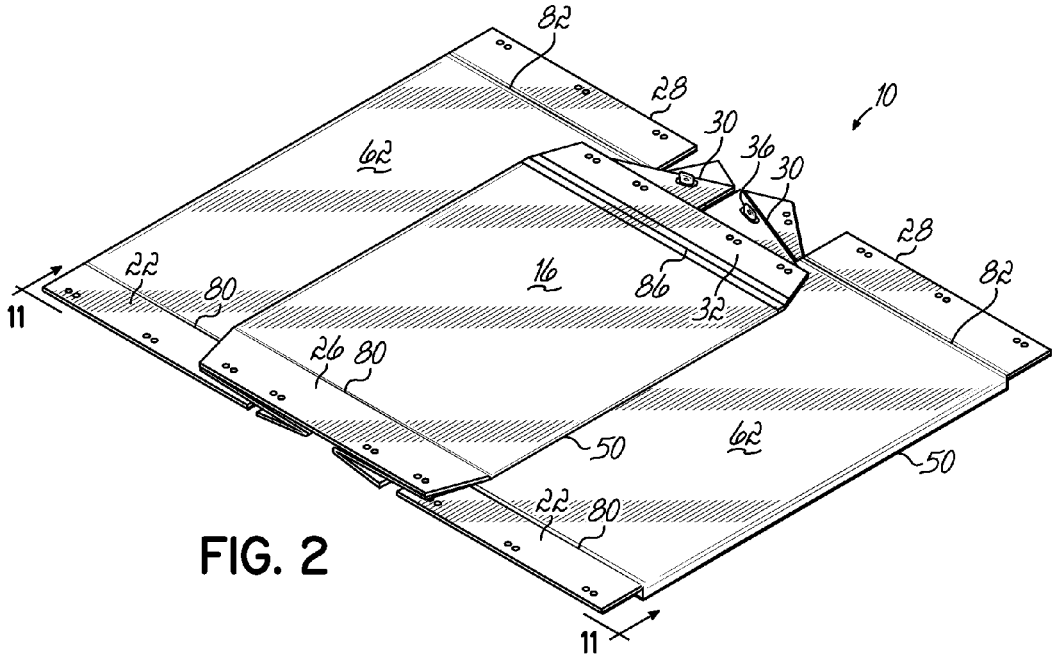
FIG. 2 is a front perspective view of the container of the present invention in a collapsed condition.
Figure 11:
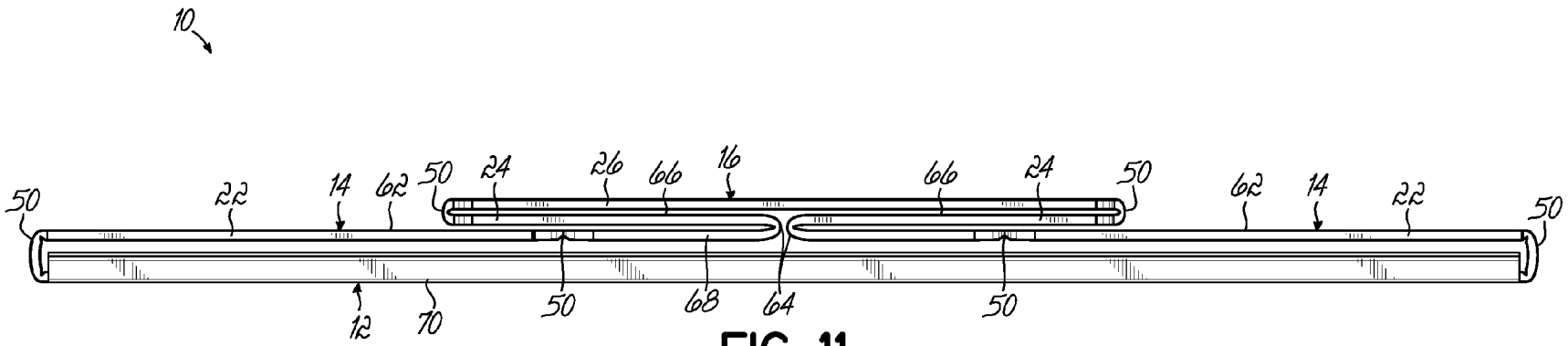
FIG. 11 is a front elevational view taken along the line 11-11 of FIG. 2.
Figure 12:
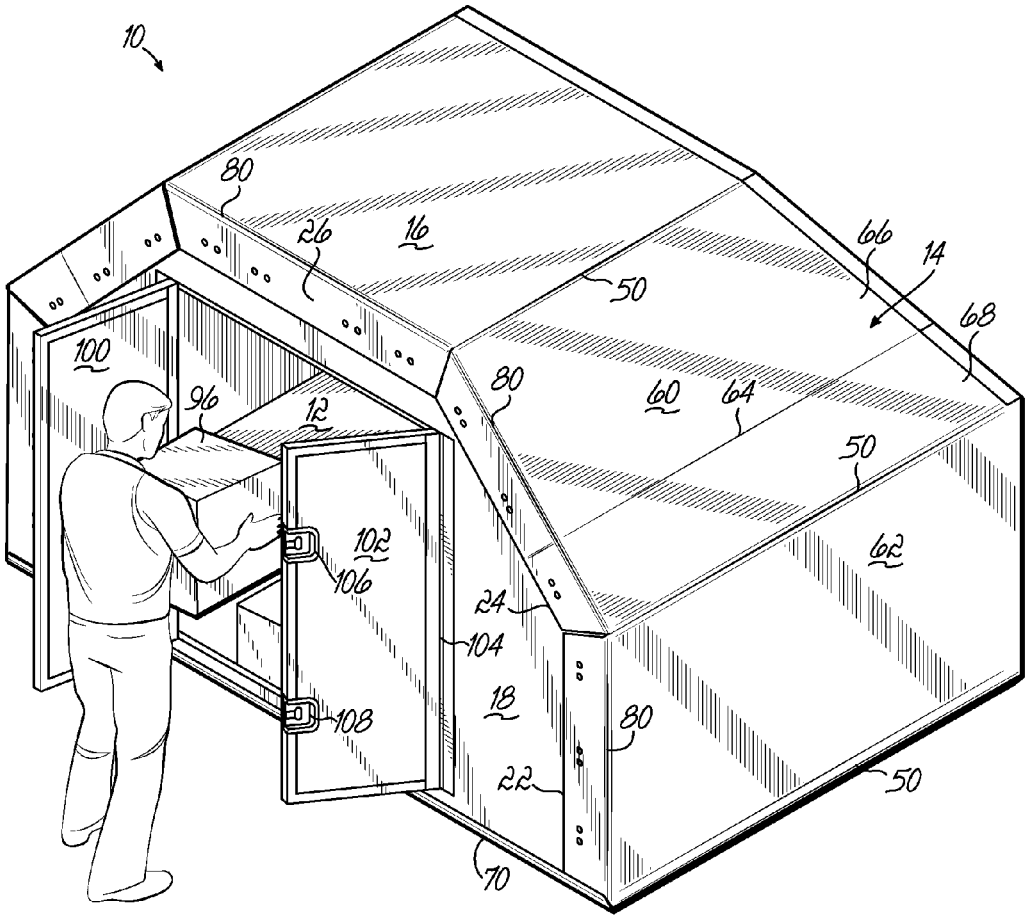
FIG. 12 is a front perspective view of the erected container of FIG. 1 illustrating products being placed into the interior of the container.

Referring to FIGS. 1 and 12, there is illustrated a collapsible container 10 according to the present invention, shown in its erected condition. In FIGS. 2 and 11, the container 10 is shown in its collapsed condition. The collapsible container 10 is designed for use inside an aircraft cargo or luggage hold, but may be used in other environments or for other purposes.

Figure 7:
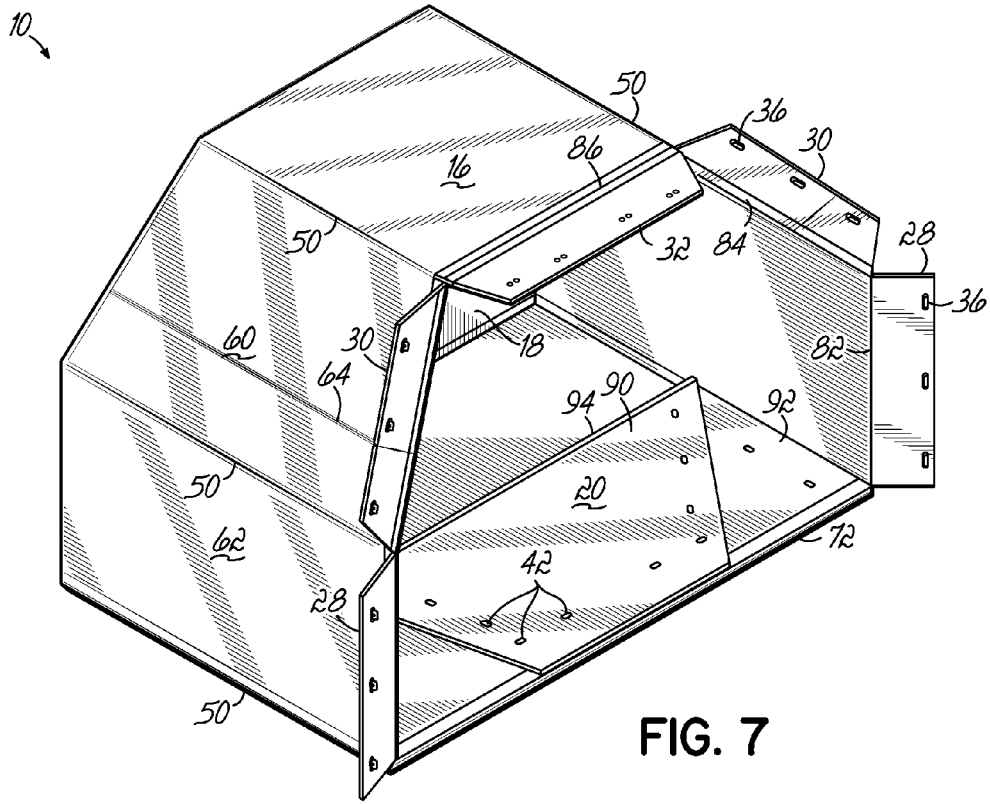
FIG. 7 is a rear perspective view of the container of FIG. 6 illustrating the back wall in a collapsed condition.
Figure 8:
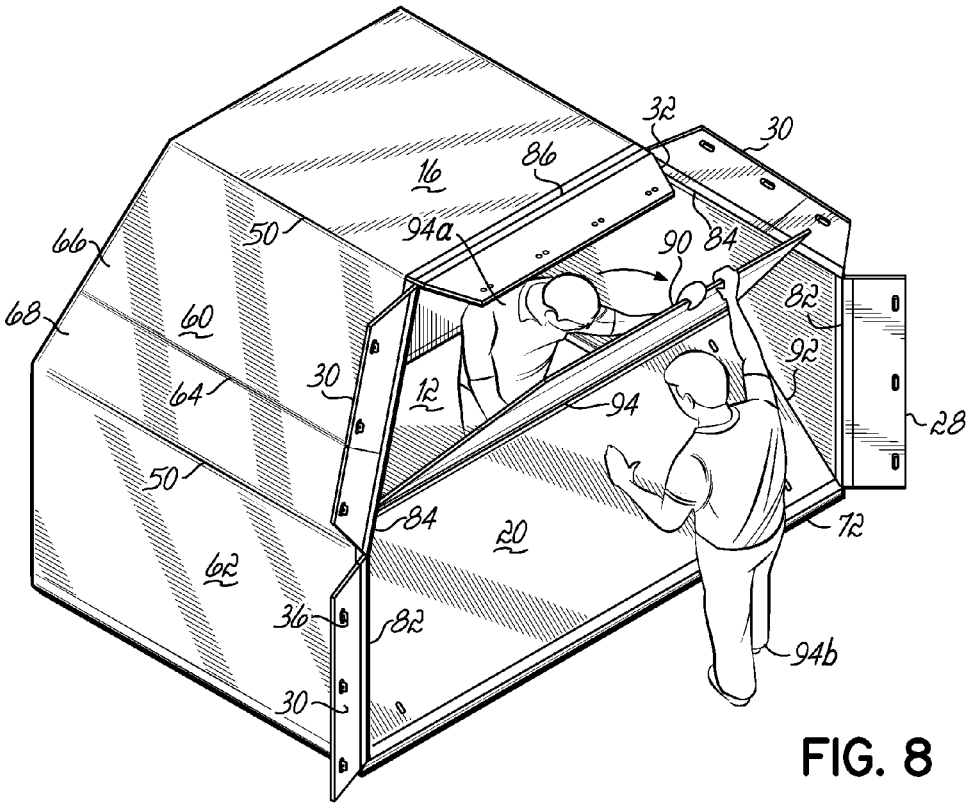
FIG. 8 is a rear perspective view of the container of FIG. 7 illustrating the back wall being erected.
Figure 9A:
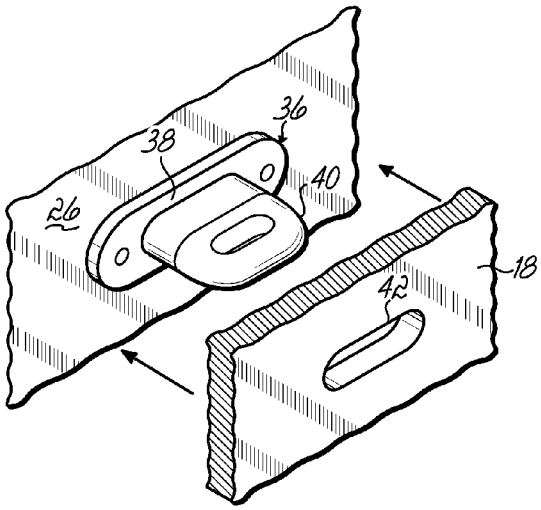
FIG. 9A is a perspective view of one of the rotatable latches used in accordance with the present invention in an unlocked position.
Figure 9B:
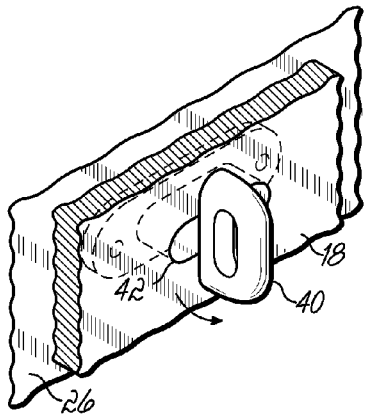
FIG. 9B is a perspective view of the rotatable latch of FIG. 9A in a locked position.
Figure 10:
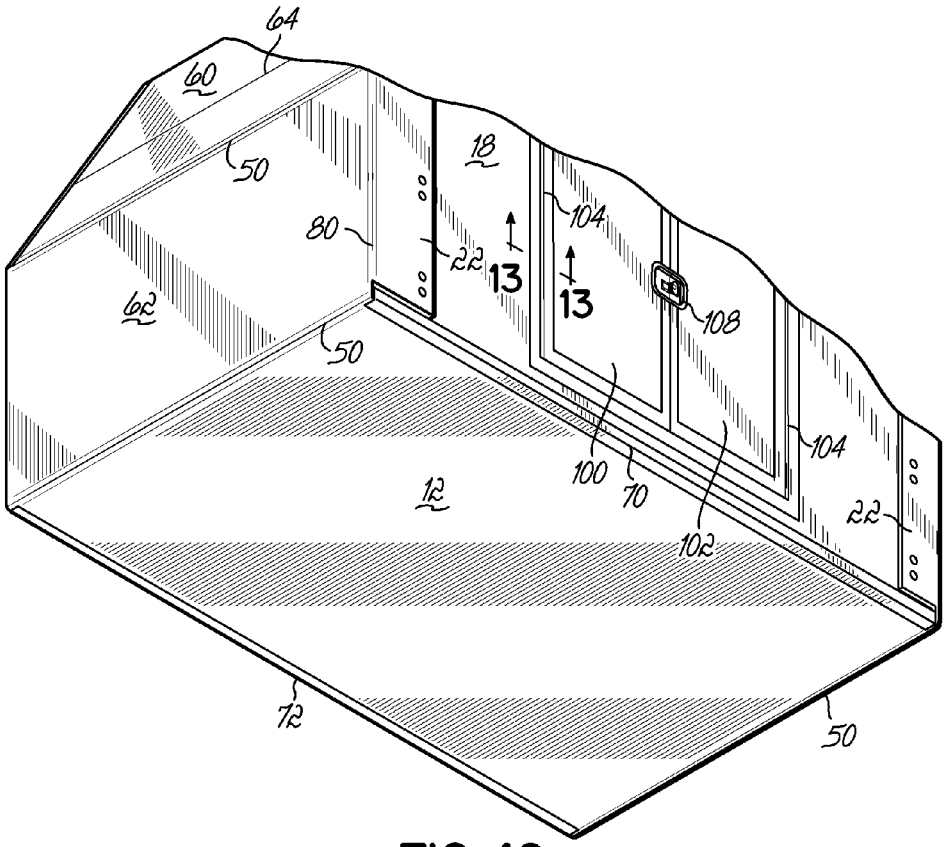
FIG. 10 is a bottom perspective view of the erected container of FIG. 1 illustrating the base of the container.

The container 10 comprises a base 12 (FIG. 10), a pair of opposed side walls 14, 14 hinged to the base 12, a top 16 hinged to the side walls 14, 14, a front wall 18 hinged to the base 12, and a back wall 20 (FIGS. 7 and 8) hinged to the base 12. At the front of the container 10, flaps 22, 24 are hinged to the side walls 14, 14, and a flap 26 is hinged to the top 16. At the back of the container, flaps 28, 30 are hinged to the side walls 14, 14, and a flap 32 is hinged to the top 16 (FIGS. 7 and 8). A door 34 is formed in one of the walls. The door can be formed in, for example, the front wall 18. Fasteners 36 (FIGS. 9A and 9B) secure the flaps 22, 24, 26, 28, 30, 32 to their respective front wall 18 and rear wall 20, when the container 10 is in the erected condition. Fasteners 36 can be of the quarter turn variety having a stationary portion 38 and a rotatable portion 40. One fastener or rotatable latch which has proven satisfactory is manufactured by Friedola Tech Holzapfel GmbH and sold as Part Number M931020. See www.friedola-tech.de. However, any other suitable latch or fastener may be used. Rotatable portion 40 is passed through a cooperating opening 42 and turned a quarter turn to secure the flaps to the side walls and top. The fasteners 36 can be attached to the flaps 22, 24, 26, 28, 30, 32 and the openings 42 can be formed in the front and back walls 18, 20, or, the fasteners 36 can be attached to the front and back walls 118, 20 and the openings 42 can be formed in the flaps 22, 24, 26, 28, 30, 32. As illustrated in FIGS. 9A and 9B, fastener 36 is mounted to the inward facing surface of flaps 26 and the corresponding opening is formed in the front wall 18; a similar mounting arrangement can be employed for flaps 28, 30, 32 and back wall 20. As shown in FIGS. 2 and 11, when the container 10 is in its collapsed condition, the front 18 and back 20 walls are collapsible upon the base 12 and the side walls 14, 14 and top 16 are collapsible upon the front 18 and back 20 walls.

The base 12, side walls 14, 14, top 16, front wall 18, and back wall 20 are preferably made of a honeycomb plastic material. For example, one such suitable plastic material from which to construct the container 10 is sold under the trademark CON-PEARL® by Friedola Gebr. Holzapfel GmbH & Co., Germany. However, other materials or other configurations may be used without departing from the present invention.

More particularly, the base 12, side walls 14, 14, and top 16 can be hinged together via living hinges 50, i.e., hinges formed by creasing, scoring, or folding the material forming the base 12, side walls 14, 14, and top 16. To increase the stiffness and structural integrity of the container 10, base 12, side walls 14, 14 and top 16 can be formed as a single, integral, one-piece, seamless structure. In other words, rather than joining separate panels of material together via extrusions or the like to form the container, one or more separate panels of material can be thermally butt welded via "hand seaming." For example, if the base 12, side walls 14, 14, and top 16 were stamped out, laser-cut for die-cut as a single sheet or blank, then only a single such butt weld would be required; if out of two sheets or blanks, then two such butt welds would be required; if out of three sheets or blanks, then three such butt welds would be required, and etc. The number of sheets or blanks required to form the base 12, side walls 14, 14, and top 16 of the container 10 is dictated by the forming machinery and its capabilities. In any event, the resulting integrally formed structure is a single, one-piece, seamless structure, and as such, exhibits superior structural integrity characteristics over a structure formed from separate panels secured together with extrusions.

Further, each side wall 14 can have an upper side wall panel 60 hinged to a lower side wall panel 62. The upper side wall panel 60 can angle inwardly relative to the lower side wall panel 62 to provide a side profile of container 10 which mates with or otherwise matches the geometry of the cargo hold of the air craft in which the container 10 is to be used. The upper side wall panel 60 can be hinged as at 64 (living hinge) to form an upper portion 66 and a lower portion 68. When the container 10 is collapsed (FIGS. 2 and 11), the upper portion 66 of the upper side wall panel 60 overlies the lower portion 68 of the upper side wall panel 60.

Figure 14:
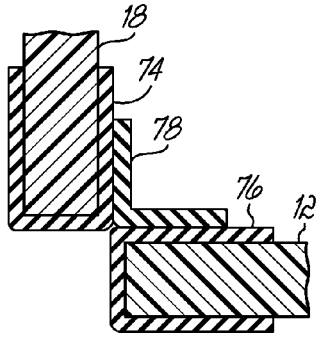
FIG. 14 is a view taken along line 14-14 of FIG. 1.

If the forming machinery is capable, the front wall 18 and the back wail 20 can likewise be hinged to the base 12 with living hinges, i.e., the base 12, side walls 14, 14, top 16, front wall 18, and back wall 20 can be stamped out, laser-cut or die-cut as a single sheet or blank. If the forming machinery is not so capable, then the front wall 18 and rear wall 20 can be hinged to the base 12 with extruded plastic hinges 70, 72, respectively. As shown in FIG. 14, hinge 70 (and 72) can include a pair of U-shaped receptacles 74, 76 and a flexible joining member 78 joining the receptacles 74, 76 and allowing them to move relative to one another. One exemplary hinge for use at 70 and 72 is an extruded plastic hinge made by the Bradford Company, Holland, Mich. Other suitable hinges may, of course, be used.

Again, if the forming machinery is capable, the front flaps 22, 24, and 26 can be stamped out, laser-cut or die-cut integral with the sheet or blank of material from which the container 10 is constructed. In that case, the flaps 22, 24, and 26 can be hinged to the lower side wall panels 62, upper side wall panels 60, and top 16, respectively with living hinges 80. The same approach can be taken with the back flaps 28, 30, 32, again with the forming machinery permitting. If the forming machinery does not permit the back flaps to be stamped out, laser-cut or die-cut integral with the sheet or blank of material from which the container 10 is constructed, one or more of the flaps can be hinged to the side walls 14, 14 and/or top 16 with extruded plastic hinges of the type discussed above. As illustrated, flaps 28 are hinged to lower side wall panels 62 with living hinges 82, whereas flaps 30 and 32 are hinged to the upper side wall panels 60 and top 16 with extruded plastic hinges 84, 86, respectively.

Referring to FIGS. 7 and 8, it will be seen that back wall 20 can have an upper portion 90 hinged to a lower portion 92. Upper portion 90 can angle forwardly relative to lower portion 92 to provide a rear profile of container 10 which mates with or otherwise matches the geometry of the cargo hold of the aircraft in which the container 10 is to be used. Again, forming machinery permitting, back wall 20 could be stamped out as a single panel, or it could be stamped out as a part of the sheet or blank of material from which the container 10 is constructed. On the other hand, if desired or required, the back wall 20 can be fabricated as shown, i.e. in hinged upper and lower portions. Upper and lower portion 90, 92 can be hinged together with a living hinge, or alternatively, and as illustrated, the portions can be hinged with an extruded plastic hinge 94 of the type described above.

As shown in the FIGS. 1, 6, 10, and 12, front wall 18 has a door 34. The door 34 can have left and right hand portions or sections 100, 102. Each door section 100, 102 can be hinged to the front wall 18 with a vertically oriented hinge 104, and is movable between a closed position as shown in FIG. 1 and an open position as shown in FIG. 12. The door sections 100, 102 can be latched or locked together in a closed position with latches 106, 108. One suitable latch is manufactured by McMaster-Carr, Aurora, Ohio, and is sold as Part Numbers 10425 A86 and 10425 A84. See www.mcmaster.com. Either or both of the latches 106, 108 can be locked if desired. Other suitable latches could as well be employed.

Figure 13:
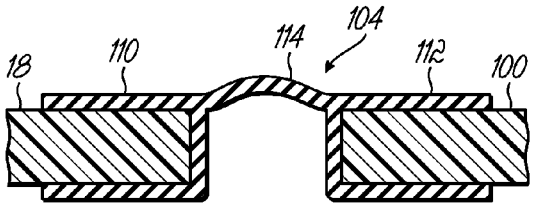
FIG. 13 is a view taken along the line 13-13 of FIG. 10.

FIG. 13 illustrates hinge 104 in further detail. Hinge 104 can be, for example, a 270 degree hinge extrusion manufactured by Filtrona Extrusion, Athol, Mass. and sold as Part Number 1440. See www.filtrona.com. However, other suitable hinges could as well be employed. For example, the hinges 70, 72 described above made by the Bradford Company, Holland, Mich. could be used as well. Hinge 104 comprises a pair of generally U-shaped receptacles 110, 112 retaining front wall 18 and the left hand door section 100, respectively. The hinge 104 further comprises a joining member 114 which enables movement of the receptacles 110, 112 and their contents relative to one another. As shown in FIG. 5, a nylon strap 50 can be attached at its upper end to the outside surface of the front wall 18 to facilitate raising the front wall 18 from a horizontal collapsed position shown in FIGS. 3 and 4 to an erected or raised position shown in FIG. 6.

Figure 3:
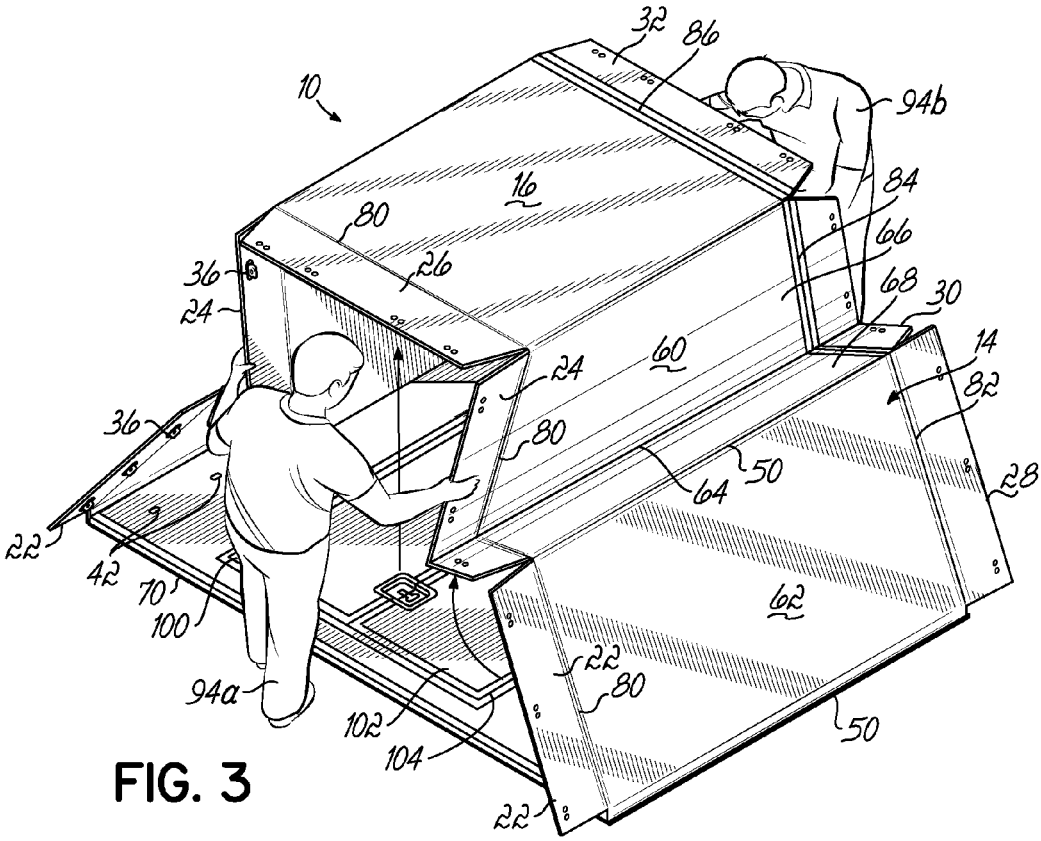
FIG. 3 is a front perspective view of the container of FIG. 2 illustrating the side walls being erected.
Figure 4:
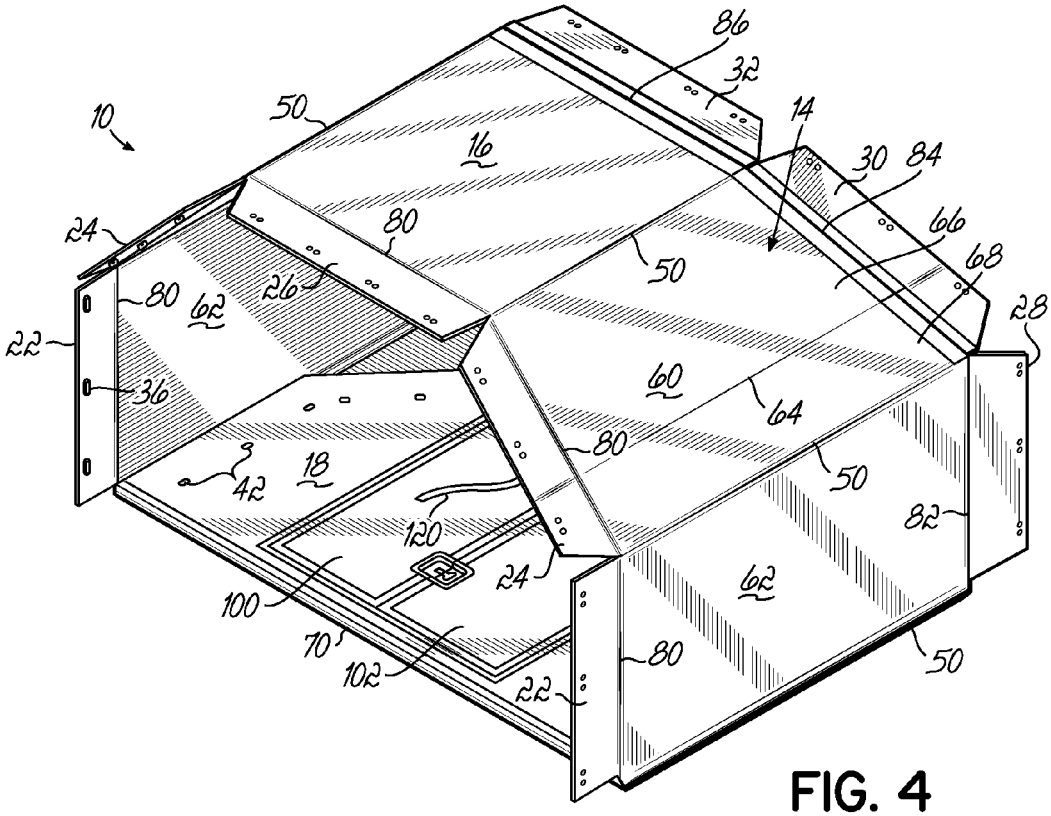
FIG. 4 is a front perspective view of the container of FIG. 3 illustrating the side walls fully erected and the front wall in the collapsed condition.
Figure 5:
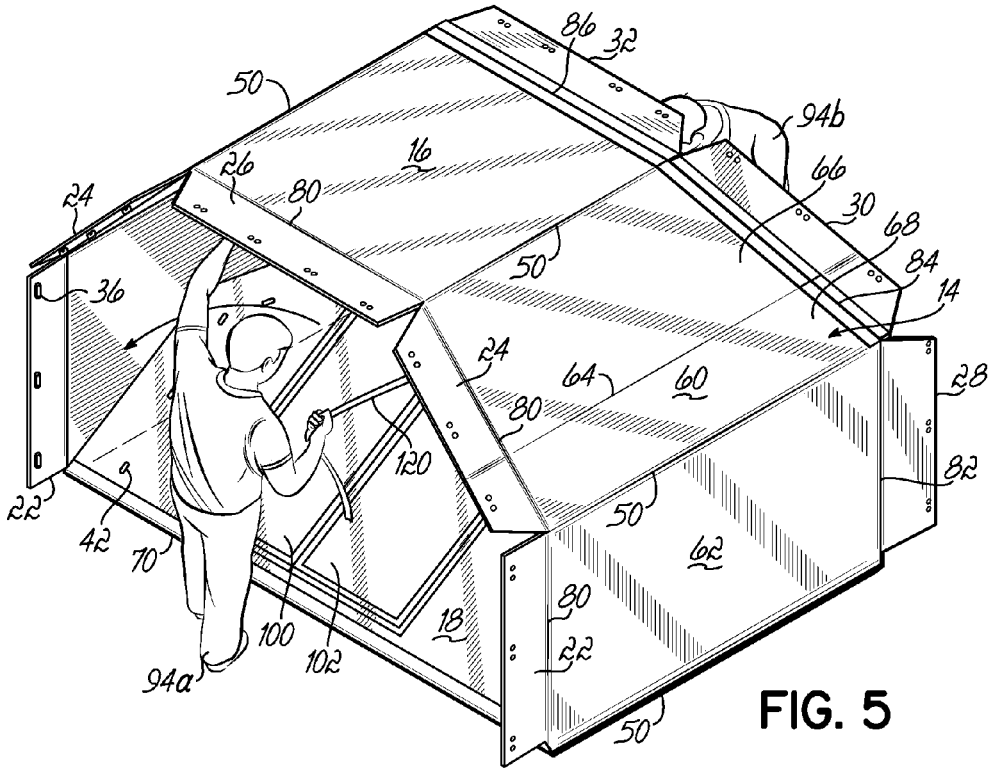
FIG. 5 is a front perspective view of the container of FIG. 4 illustrating the front wall being erected.

Referring now to FIGS. 3-12, the steps in the method of erecting the collapsible container 10 are illustrated. A pair of operators or assemblers 94*a* and 94*b* first lift the top 16 and upper side wall panels 60 of side walls 14 as shown in FIG. 3, thereby erecting side walls 14 as shown in FIG. 4. At this point, the front and back walls 18, 20 are still in their collapsed condition atop base 12.

As shown in FIG. 5, operator 94*a* grabs strap 120 and pulls it upwardly and forwardly to raise or pivot upwardly front wall 18. Front wall 18 is raised first since it lays on top of rear wall 20 when the front and rear walls 18, are collapsed upon base 12.

Figure 6:
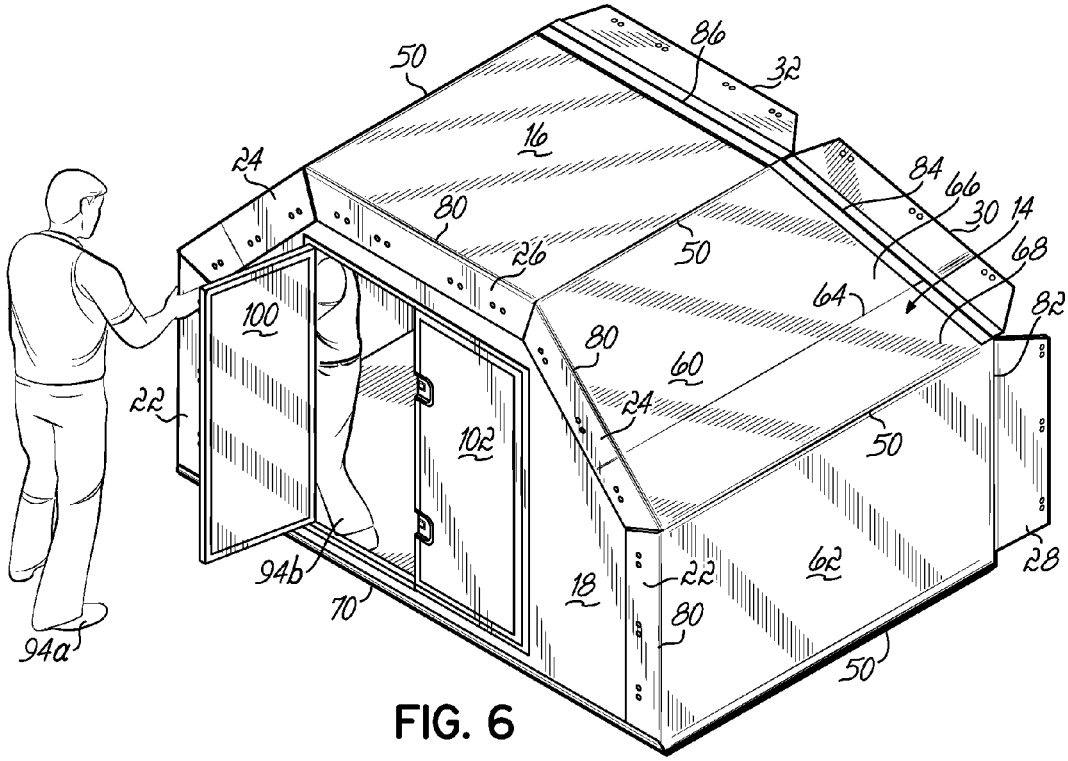
FIG. 6 is a perspective view of the container of FIG. 5 illustrating the flaps being secured to the front wall of the erected container.

As shown in FIG. 6, after the front wall 18 is erected or raised, assembler 94*a* opens the door 34 and enters the interior of the partially erected container 10. The other assembler 94*b* remains outside the container 10. The assembler 94*b* folds the flaps 22, 24, 26 against the front wall 18 causing the rotatable portions 40 of the latches 36 to pass through openings 42 in front wall 18 as shown in FIG. 9A. The assembler 94*a* inside the container 10 rotates the rotatable portions 40 of the latches 36 as shown in FIG. 9B to secure the side walls 14 and top 16 to the front wall 18.

The assembler 94*a* next turns his attention to the back wall 20. Assembler 94*b* steps around to the back of the container 10. Assembler 94*a* raises the upper and lower portions 90, 92 of the back wall 20 upwardly, pivoting the back wall 20 rearwardly relative to the base 12. Once he is able to reach it, assembler 94*b* grasps the upper portion 90 of the back wall 20 and raises it upwardly and forwardly, thereby pivoting the upper portion 90 forwardly relative to the lower portion 92. Once back wall 20 is completely erected, the assembler 94*b* folds the flaps 28, 30, 32 against the back wall 20 causing the rotatable portions 40 of the latches 36 to pass through openings 42 in back wall 20 as shown in FIG. 9A. The assembler 94*a* inside the container 10 rotates the rotatable portions 40 of the latches 36 as shown in FIG. 9B to secure the side walls 14 and top 16 to the back wall 20.

After the container 10 is fully assembled, the door 34 may be closed and locked, if necessary, after products or items 96 are loaded inside the interior 98 of the container 10. See FIG. 12.

To collapse the erected container 10, the above steps are performed in reverse. The resulting collapsed container 10, as shown in FIG. 11, has the front and back walls 18, 20 collapsed upon the base 12 and the side walls 14 and top wall 16 collapsed upon the front and back walls 18, 20. More particularly, the upper portion 66 of each upper side wall panel 60 folds about hinge 64 so that the upper portion 66 of each upper side wall panel 60 overlies the lower portion 68 of each upper side wall panel 60.

The embodiments of the invention shown and described are for illustrative purposes only. The drawings and the description shall not limit in any way the scope of the invention as defined in the claims. While those skilled in the art may make various changes to, or additional embodiments of, the invention, none of those changes/embodiments shall be deemed to depart from the spirit of the invention. Thus, all such changes/embodiments shall be embraced by the scope of the invention as defined in the claims.

For example, the claims are not limited to the illustrated order of collapsing (and erecting) the side walls, top, and front and back walls. Any other order of collapsing (and erecting) the container shall be within the scope of the claims. In other words, the order of collapsing (and erecting) the top and side walls, and the front and back walls, can be reversed. That is to say, the front and back walls can be collapsed first upon the base, and then the top and side walls can be collapsed onto the front and back walls. And, the order of collapsing (and erecting) the front and back walls can be reversed. That is to say, the front wall can be collapsed first upon the base, and then the back wall can be collapsed upon the front wall. And, the order of collapsing (and erecting) the top and side walls can be reversed. That is to say, the top can be collapsed first upon the base, and then the side walls can be collapsed upon the top.

Furthermore, an alternating order of collapsing (and erecting) can be employed. That is to say, the front wall can be collapsed first, the top and side walls can be collapsed second, and the back wall can be collapsed third. Or, the back wall can be collapsed first, the top and side walls can be collapsed second, and the front wall can be collapsed third. And, within such an alternating order of collapsing (and erecting) the container, the order of collapsing the top and side walls can be reversed. All of these combinations and permutations of collapsing the container result in a collapsed container wherein the side walls, top, front wall, and back wall are substantially parallel to, and generally in close proximity to, the base, and accordingly, any and all combinations and permutations of collapsing the elements of the collapsible container of this invention are within the scope of the claims.

Accordingly, the invention is to be limited only by the scope of the following claims and their equivalents.

The invention claimed is:

1. A method of erecting a collapsed cargo container comprising the steps of:

providing a collapsed cargo container having a base, a pair of opposed side walls hinged to the base, each of said side walls comprising an upper side wall panel hinged to a lower side wall panel, the upper side wall panel being angled inwardly relative to the lower side wall panel when the container is in an erected condition, a top hinged to the side walls with living hinges, a front wall hinged to the base, a back wall hinged to the base, flaps hinged to each of the panels of the side walls and the top, and a door formed in the front wall, lifting the top and side walls of the container to thereby erect the side walls of the container, lifting the front wall of the container to pivot the front wall of the container forwardly relative to the base of the container, fastening flaps on the side walls and top to the front wall with fasteners, lifting the back wall of the container to pivot the back wall of the container rearwardly relative to the base of the container, and fastening flaps on the side walls and top to the back wall with fasteners.

2. The method of claim 1 wherein the fasteners are rotatable latches attached to the flaps, and further comprising the steps of:

providing openings in the front and back walls, passing the rotatable latches through the openings, and rotating the latches.

3. A method of erecting a collapsed cargo container comprising the steps of:

providing a collapsed cargo container having a base, a pair of opposed side walls hinged to the base, each of said side walls comprising an upper side wall panel hinged to a lower side wall panel, the upper side wall panel being angled inwardly relative to the lower side wall panel when the container is in an erected condition, a top hinged to the side walls with living hinges, a front wall hinged to the base, a back wall hinged to the base, flaps hinged to each of the panels of the side walls and the top, and a door formed in one of the walls, the side walls, top, front wall, and back wall being collapsed so as to be substantially parallel to, and generally in close proximity to, the base, in no particular order:

lifting the top and side walls of the container to thereby erect the side walls of the container, lifting the front wall of the container to pivot the front wall of the container forwardly relative to the base of the container, fastening flaps on the side walls and top to the front wall with fasteners, lifting the back wall of the container to pivot the back wall of the container rearwardly relative to the base of the container, and fastening flaps on the side walls and top to the back wall with fasteners.

4. The method of claim 3 wherein the fasteners are rotatable latches attached to the flaps, and further comprising the steps of:

providing openings in the front and back walls, passing the rotatable latches through the openings, and rotating the latches.

5. A method of erecting a collapsed cargo container comprising the steps of:

providing a collapsed cargo container having a base, a pair of opposed side walls hinged to the base with living hinges, each of said side walls comprising an upper side wall panel hinged to a lower side wall panel, the upper side wall panel being angled inwardly relative to the lower side wall panel when the container is in an erected condition, a top hinged to the side walls, a front wall hinged to the base, a back wall hinged to the base, flaps hinged to at least some of the walls, and a door formed in at least one of the walls, moving the top relative to the base of the container to thereby erect the side walls of the container, pivoting the front and rear walls of the container relative to the base of the container, securing the side, front and back walls together with fasteners.

* * * * *